US008104744B2

(12) United States Patent
Brownbill

(10) Patent No.: US 8,104,744 B2
(45) Date of Patent: Jan. 31, 2012

(54) PANEL WITH HIDDEN ATTACHMENT MEANS

(76) Inventor: Alan Brownbill, Kingscliff (AU)

( * ) Notice: Subject to any disclaimer, the term of this patent is extended or adjusted under 35 U.S.C. 154(b) by 0 days.

(21) Appl. No.: 11/364,651

(22) Filed: Feb. 28, 2006

(65) Prior Publication Data

US 2007/0015390 A1 Jan. 18, 2007

Related U.S. Application Data

(63) Continuation-in-part of application No. PCT/AU2004/001278, filed on Sep. 17, 2004.

(30) Foreign Application Priority Data

Sep. 22, 2003 (AU) ..... 2003248210

(51) Int. Cl.
*E04H 17/00* (2006.01)

(52) U.S. Cl. ..... 256/65.11; 256/22

(58) Field of Classification Search ..... 256/22, 256/59, 65.01
See application file for complete search history.

(56) References Cited

U.S. PATENT DOCUMENTS

| | | | | | |
|---|---|---|---|---|---|
| 1,114,486 | A | * | 10/1914 | Kimball | 5/283 |
| 1,791,680 | A | * | 2/1931 | Miller | 52/690 |
| 2,808,233 | A | * | 10/1957 | Spescha | 256/22 |
| 3,221,467 | A | * | 12/1965 | Henkels | 52/690 |
| 3,471,128 | A | * | 10/1969 | Jefferys | 256/22 |
| 3,506,243 | A | * | 4/1970 | Seiler | 256/59 |
| 3,522,933 | A | * | 8/1970 | Braun | 256/22 |
| 4,146,212 | A | * | 3/1979 | Lermer | 256/68 |
| 4,154,431 | A | * | 5/1979 | Burnbaum | 256/19 |
| 4,451,025 | A | * | 5/1984 | Spera | 256/65.12 |
| 4,723,760 | A | * | 2/1988 | O'Sullivan | 256/22 |
| 5,443,244 | A | | 8/1995 | Gibbs | |
| 5,454,548 | A | | 10/1995 | Moore | |
| 5,967,498 | A | | 10/1999 | Junell | |
| 5,992,828 | A | * | 11/1999 | Burdick | 256/10 |
| 6,254,064 | B1 | * | 7/2001 | Gibbs | 256/22 |
| 6,739,583 | B2 | * | 5/2004 | Ryon | 256/65.02 |
| 6,824,123 | B2 | * | 11/2004 | Larsen et al. | 256/65.01 |
| 2002/0175321 | A1 | * | 11/2002 | Larsen et al. | 256/65.1 |
| 2003/0127639 | A1 | * | 7/2003 | Ryon | 256/65.02 |
| 2006/0226407 | A1 | * | 10/2006 | Auret | 256/22 |

FOREIGN PATENT DOCUMENTS

| | | |
|---|---|---|
| EP | 0381289 | 8/1990 |
| GB | 2373260 | 9/2002 |
| NL | 1002257 | 10/1997 |
| WO | WO 97/11241 | 3/1997 |

OTHER PUBLICATIONS

International Search Report; PCT/AU2004/001278; Nov. 18, 2004.
Written Opinion of the ISA; PCT/AU2004/001278; Nov. 18, 2004.

* cited by examiner

*Primary Examiner* — Joshua Kennedy
(74) *Attorney, Agent, or Firm* — Cantor Colburn LLP

(57) ABSTRACT

A panel including a plurality of first members disposed in a first direction, at least some of the first members defining a first part of a passageway, at least one second member disposed in a second direction and defining a second part of the passageway, the second member having a plurality of openings for at least partially receiving a first member, and at least one elongate locking member, adapted to pass through the passageway, and substantially in alignment with the first member or the second member to lock the first member relative to the second member.

21 Claims, 8 Drawing Sheets

PANEL WITH HIDDEN ATTACHMENT MEANS

CROSS REFERENCE TO RELATED APPLICATIONS

This application is a continuation-in-part of International Application No. PCT/AU2004/001278 filed on 17 Sep. 2004 designating the United States of America, said International Application being incorporated herein by reference in its entirety. This application is further related to and claims the benefit under 35 U.S.C. §119 and under the Paris Convention to Australian Patent Application No. 2003248210 filed on 22 Sep. 2003 to which International Application No. PCT/AU2004/001278 claims priority, said Australian Application being incorporated herein by reference in its entirety.

TECHNICAL FIELD OF THE INVENTION

The present invention relates to panels and attachment means for attaching one member to another and in particular to an improved style of construction for lattice, fencing, roofing, awnings and the like.

BRIEF DISCUSSION OF RELATED ART

Lattice, fencing, roofing, and awning structures are very popular and are used for many purposes. They are generally required to combine desirable characteristics of strength, light weight, and low cost. A typical fence structure for example, is formed from straight elements such as paling elements arranged in a generally vertical direction with one or more generally horizontal rail elements in a crossing pattern and fastened together, forming openings between the palings, but preventing entry or exit of anything larger than the opening dimension.

The conventional fence structure typically has two horizontal rail elements to make the overall structure stronger, and they are attached to one or more spaced apart fence posts which are embedded in the ground. They are also used for joining with other fence portions to from the fence or divider.

By varying structural dimensions and relationships in the assembly of a conventional fence structure, the style and security provided by the fence may be varied. For example, fences may be formed in a loop-top, flat-top or spike-top pattern by using different shaped palings. The attachment of the palings to the horizontal elements form regular and repeatable openings due to the spacing of the palings.

Conventional fence structures are generally formed of straight vertical elements, or slats, and perpendicular spacing elements. Although these structures have many uses, the geometry is not pleasing to everyone, and the use of such structures is thus somewhat limited. The vertical elements may be simple elongate post-like members or they may be U-shaped members in order to provide the loop-top fence. These may have a different appeal and be more aesthetically pleasing to some consumers.

In construction of conventional fences in particular, the palings of the vertical direction are generally disposed over the rails and attached thereto. Therefore they are generally wider than the thickness of a single member. These are generally fixed to one another using a fastener of some kind, usually nails, screws or staples. For metal fencing, welding or a similar process may be used.

The areas where the palings and rails overlap are also sometimes provided with a rebated portion allowing the slats to fit together forming a structure having a single slat thickness. Rebating however generally only works well with wooden constructions, metal being difficult to apply a rebate to.

Both the method of using fasteners and the provision of rebates weaken the fencing structure. They provide points of weakness about which the palings in particular may splinter.

Fences formed in the usual ways also tend to sag when not supported or when the fence panel is larger. The weight of the palings and the entire fence panel bears on the fasteners and the rebates and may affect the strength or integrity of the fence. For this reason, these types of fences are unsuitable for use in security situations, particularly in situations such as pool fences.

Fences may also be manufactured using a preformed panel often made using a plastic sheet with the fence pattern of rails and palings stamped out of the sheet. Fencing formed in this manner is quite thin, as it must be pressed out by a machine while the plastic is still cooling after the sheet is extruded. This type of plastic lattice is usually weaker and may be used for ornamental applications. It is generally unsuitable for security situations and also tends to sag.

The most common materials used in the construction of fence panels are wood, plastic and light metals such as aluminium. Wood has many disadvantages, such as being relatively heavy for a given strength, as well as splitting and breaking under impact. Furthermore, wood will tend to rot and decay under most conditions and must be protected either by a preservative finish using an expensive chemical treatment or else painted with appropriate decorative finishes which must be reapplied periodically. Thus the complete cost of a wood fence is not only the original cost of erecting it, but also the continuing cost of maintenance and repair.

In order to overcome the problems with wood as a fencing material, a number of substitutes have been proposed, particularly plastics, and of these polyvinyl chloride or PVC has been one of the most popular. PVC has the advantages of easy fabrication by extrusion, molding and other processes, as well as reasonable cost and durability, since it can easily be coated with the necessary protective and finishing materials. PVC is however generally weaker than metals.

Aluminium is also used in construction and is used in security fencing such as pool fences. These constructions are often riveted together and the rivets therefore offer points of weakness about which the fence may bend.

BRIEF SUMMARY OF THE INVENTION

The present invention is directed to a panel with hidden attachment means, which may at least partially overcome the abovementioned disadvantages or provide the consumer with a useful or commercial choice.

In one form, the invention resides in a panel comprising a plurality of first members disposed in a first direction, at least some said first members defining a first part of a passageway, at least one second member disposed in a second direction and defining a second part of the passageway, the second member having a plurality of openings for at least partially receiving a said first member, and at least one elongate locking member, adapted to pass through the passageway, and substantially in alignment with the first member or the second member to lock the first member relative to the second member.

In use, the first members are positioned through the second members. The locking member may then be forced through the passage formed between them. In one form, the part of the passageway defined by the first member may be a wall of at least some said first members and the part of the passageway defined by the second member may be a wall of the second member. The locking member may suitably be disposed between the walls of the first members and the second member and lock them relative to each other by a friction or interference fit.

In an alternative embodiment, the first members may be provided with a depression defining part of the passageway. The part of the passageway defined by the first member may be a depression in at least some said first members and the part of the passageway defined by the second member may be a wall of the second member. The depressions on first members may be aligned to allow the locking member. The locking member may engage with the depression on the first members and the wall of the second member to lock the members relative to each other.

In this manner, the attachment means may be inside the second members and is therefore hidden from sight. These embodiments may not be completely suitable for security panels as there may be some small degree of movement of the second members allowed if a significant force is applied to the second member. The opening on the passage portions allows the locking member to be manipulated when forcing it through the passage portions in order to adjust the alignment of the locking member.

According to a particularly preferred embodiment, the invention resides in a panel comprising a plurality of first members disposed in a first direction, at least some said first members defining a first part of a passageway in the form of an opening, at least one second member disposed in a second direction and defining a second part of the passageway, the at least one second member having a plurality of openings therein, each opening in the at least one second member for at least partially receiving a first member, the second member including at least one passage portion, and at least one elongate locking member, wherein the at least one elongate locking member passes through the at least one passage portion and through the opening in the first member to attach the first member relative to the at least one second member.

Preferably, each at least one passage portion has a periphery which extends substantially about the at least one elongate locking member, when assembled, with at least one opening in a wall of the periphery to allow adjustment to the at least one locking member as it passes through the passage portion. The passage may act to align the elongate locking member with the openings in the first members. The periphery may be or include a portion of a wall of the second member. The opening in the periphery may extend through the wall of the periphery may be through the wall of the second member itself. Alternatively, the opening may be internal to the second member. For example, the periphery may be an open topped channel located in the interior of the second member.

In use, the first members are positioned through the second members and the openings in the first members are aligned with each other and the periphery of the passage portions. The locking member may then be forced through the passage portions and the openings in the first members, locking the first members to the second members. The attachment means is suitably located inside the second members and is therefore hidden from sight. The opening on the passage portions suitably allows the locking member to be manipulated when forcing it through the passage portions in order to adjust or correct the alignment of the locking member.

Panels may be formed in this manner without rivets or other fasteners. The panel is also less likely to sag under its own weight. The removal of the overlapping slats results in a slimmer panel which may be used in security situations as doors or window panels or in a larger form as a fence or wall panel. Depending upon the shape of the first and second members, the panel may also be used a roof, balustrade or awning.

There will suitably be more than one second member disposed in the second direction. The plurality of first members will preferably take the form of paling members disposed on one direction and the second members will suitably be disposed in a second direction to form a network. The first members and the at least one second member will typically be oriented approximately perpendicular to each other and the network will therefore preferably have a cross-like appearance.

Each first member may preferably be an elongate strip member. The members may of course be of any cross-section required by a user or manufacturer of the panels. For example, a round member may be preferred by a consumer for aesthetic reasons or to reduce the appearance of the panel as a two-dimensional panel. The members may preferably not be rectangular or other shape possessing sharp corners or apices as these could weaken the overall structure of the panel. Members of these shapes may however be used in some situations. It is also anticipated that the first member may take on a foil shape, being substantially oval in cross-section but having flattened sidewalls.

The material used for construction of the each of the members may preferably be a light but strong metal such as aluminium or plastic. This will suitably provide the panel with the strength required to be used in security situations but remain light and slimmer in appearance than heavier or denser materials.

The shape of the network of members may be of any shape required by a consumer. Such shapes may be rectangular in appearance, but it may also be diamond shaped (or angled to the horizontal), or rounded in appearance. The shape of the panel and the network may also be abstract or freeform.

The arrangement of the network itself may preferably be an orderly array of members with the intersection of each first member with a second member providing a fixture point where the locking member attaches the first member to the second member. The fixture points may suitably be arranged in any two or three-dimensional pattern. Such pattern may be regular or abstract.

By varying structural dimensions and relationships in the assembly of the panel network, the relative area of any openings between the first members may be varied. The spacing of the members in the present invention may preferably be such that the openings are large enough to allow an unobstructed view or passage of air but small enough to provide security when necessary.

The openings in the panel may suitably be of any shape also, and will preferably be related to the array of the network.

The size of the panel may be varied to suit the application to which the panel is to be put. For example, when used as a fence, the panel will preferably be between 0.9 and 3 meters in height and 0.5 to 3 meters in width. More than one panel may be used to form a fence. When used in other situations, the panel will be suitably sized in order to achieve its purpose.

Each first member may preferably be round, rectangular or substantially oval in cross-sectional shape. It may also preferably have a cross-sectional shape having two substantially linear, parallel sidewalls and two arcuate end walls or foil-shaped.

Each first member may preferably be extruded. The extrusion may be of any length required. It is anticipated that U-shaped first members may be used to form a loop-top fence.

Each first member may have any dimensions, but preferably may be between approximately 1 cm and 10 cm in width, and any length.

Each first member preferably may be tubular in construction. The tubular construction will preferably provide strength and rigidity to the panel but not add excessive weight to the construction. However, a solid construction may preferably be used in specific situations. The or each first member may also have a planar configuration. For example, an awning may be formed according to the present invention by using planar first members oriented substantially horizontally and downwardly angled with a pair or more of second member oriented substantially vertically. Each of the second members may utilize a locking member to fix the awning blades (first members) in position.

Each first member has at least one opening therethrough and the opening may be in the form of a passage disposed through it. There may be a plurality of passages. The passages in adjacent first members may suitably be coaxial. Each passage may preferably approximate the size and/or shape of the exterior of the elongate locking member. The passage will preferably be sized to provide an interference fit with the elongate locking member. The interference fit may be a tight interference fit or a loose interference fit. The second members may be provided with one or more internal flanges, located inside the second member substantially opposite the respective openings in the second member which the first members extend at least partially into, the flanges to receive and locate the end of the first members therein or through.

The passages are suitably shaped to receive the elongate locking member in a way that the elongate locking member may be pushed through the passages in adjacent first members without the use or a hammer or like device. The passage may suitably be sized to firmly grip the elongate locking member but not to deform the elongate locking member when it passes through said passage.

The wall thickness of each first member will preferably be similar and be between approximately 0.5 mm and 10 mm. Thicker walls may be provided for members in larger panels, as those members will have to support a greater weight.

Each second member may preferably be substantially rectangular in cross-sectional shape. The passage portions may preferably be disposed within the rectangular cross-section of the second member.

Each second member may preferably be extruded. The extrusion may be of any length required.

Each second member may have any suitable dimensions, but preferably may be between approximately 1 cm and 10 cm in a first direction, 1 mm to 10 cm in a second direction and of any suitable length.

Each second member may be solid, but preferably will be tubular in construction, with the passage portions dispose within the hollow interior. The tubular construction will preferably provide strength and rigidity to the panel but not add excessive weight to the construction. Solid construction may preferably be used in specific situations.

Each second member also has at a plurality of openings disposed through it to receive the first members. These openings may be passages and are suitably spaced along each second member.

The wall thickness of each second member will preferably be similar and be between approximately 0.5 mm and 10 mm. Thicker walls may be provided for members in larger panels, as those members will have to support a greater weight.

Each second member is preferably disposed substantially perpendicular to the first members to form a two-dimensional panel.

The locking member may preferably be extruded in a continuous manner and cut to length. It may be of any shape but is preferably shaped to correspond to the shape of the passageway. For example, the locking member may be a rectangular, circular or oval-shaped rod. The locking member may have an at least partially conical or tapered end in order to make driving the member into the passageway easier. The locking member may suitably be of a constant cross-section over its length. It may include at least one protruding section to allow engagement with the opening in the periphery of the passageway. This may give the locking member a keying function and assist with the alignment of the locking member with the passageway.

As may be appreciated, the invention is described herein with particular reference to a fence panel. It is to be appreciated that the invention may apply equally to an awning or a roof structure as well. Other applications may become evident upon further explanation of the invention.

BRIEF DESCRIPTION OF THE DRAWINGS

Various embodiments of the invention will be described with reference to the following drawings, in which.

DETAILED DESCRIPTION OF THE INVENTION

Figure 1:
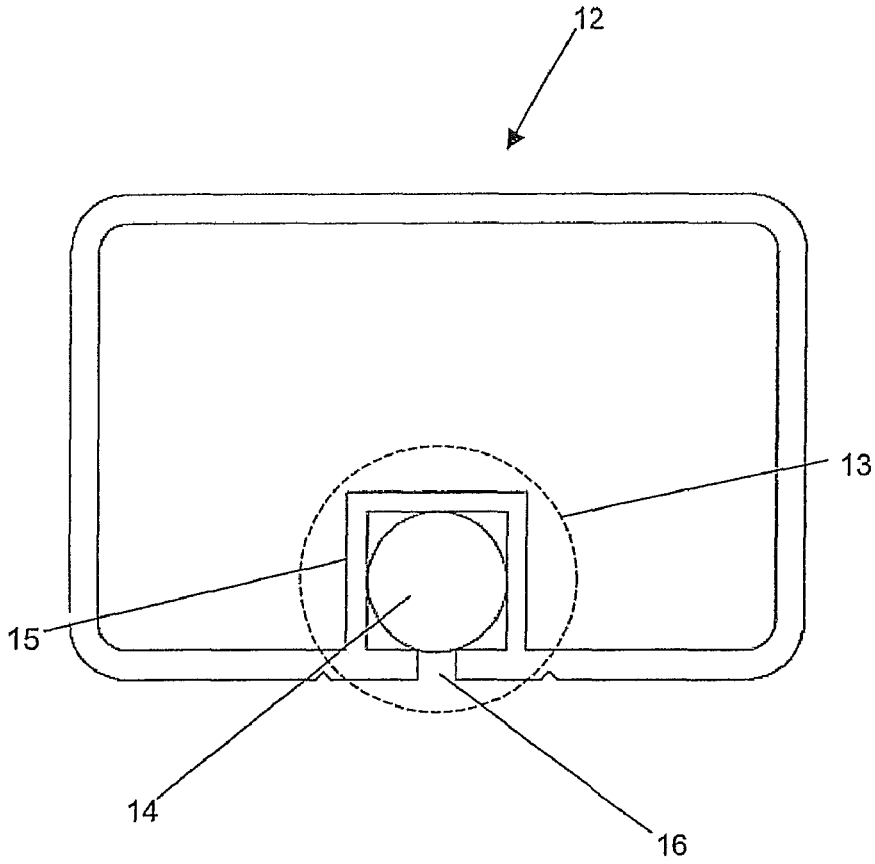
FIG. 1 shows a sectional view of a second member with locking member in place according to an aspect of the present invention.

In one broad form, the present invention provides a panel 10 with hidden attachment means, the panel 10 comprising a plurality of first members 11 disposed in a first direction, each having at least one opening therethrough, at least one second member 12 disposed in a second direction having a plurality of openings therein, each opening in the at least one second member 12 for at least partially receiving a first member 11, the second member 12 including at least one passage portion 13, and at least one elongate locking member 14, wherein the at least one elongate locking member 14 passes through the at least one passage portion 13 and through the opening in each first member 11 to attach each first member 11 to the at least one second member 12.

Each at least one passage portion 13 has a periphery 15 which extends substantially about the at least one elongate locking member 14, when assembled, with at least one opening 16 in a wall of the periphery 15 to allow adjustment to the locking member 14 as it passes through the passage portion 13. The opening 16 in the passage portion 13 can be used to align the elongate locking member 14 with the openings in the first members 11.

Figure 2:
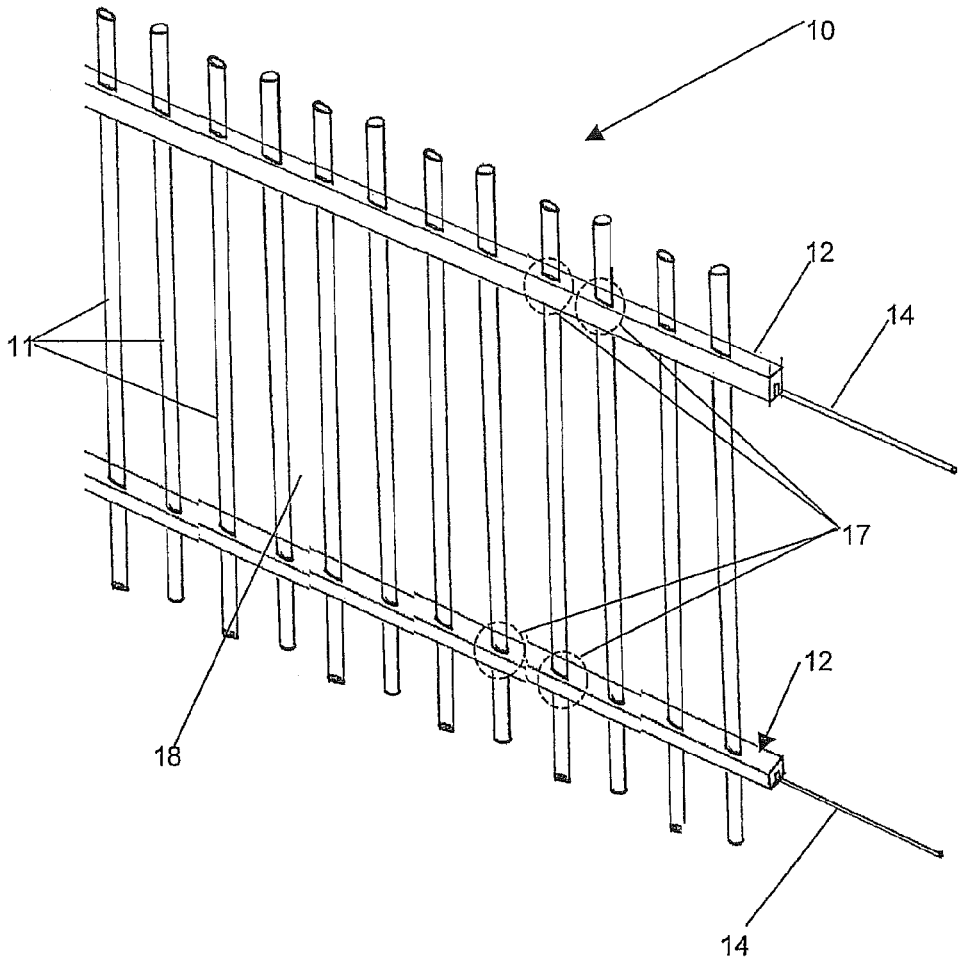
FIG. 2 shows a perspective view of a fence assembly assembled according to a preferred aspect of the present invention.
Figure 3:
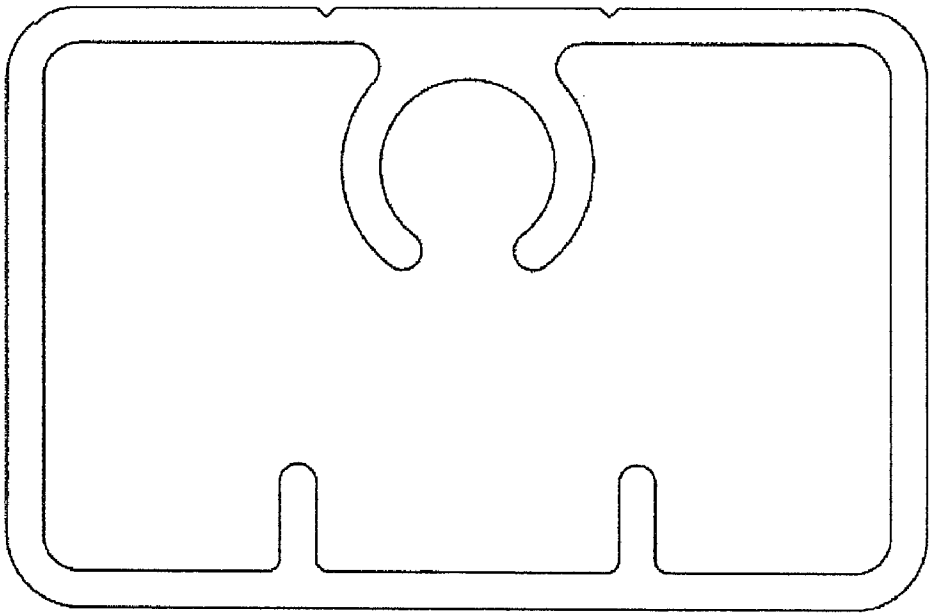
FIG. 3 shows a cross-sectional views of a rectangular second member according to a preferred embodiment of the present invention.
Figure 4:
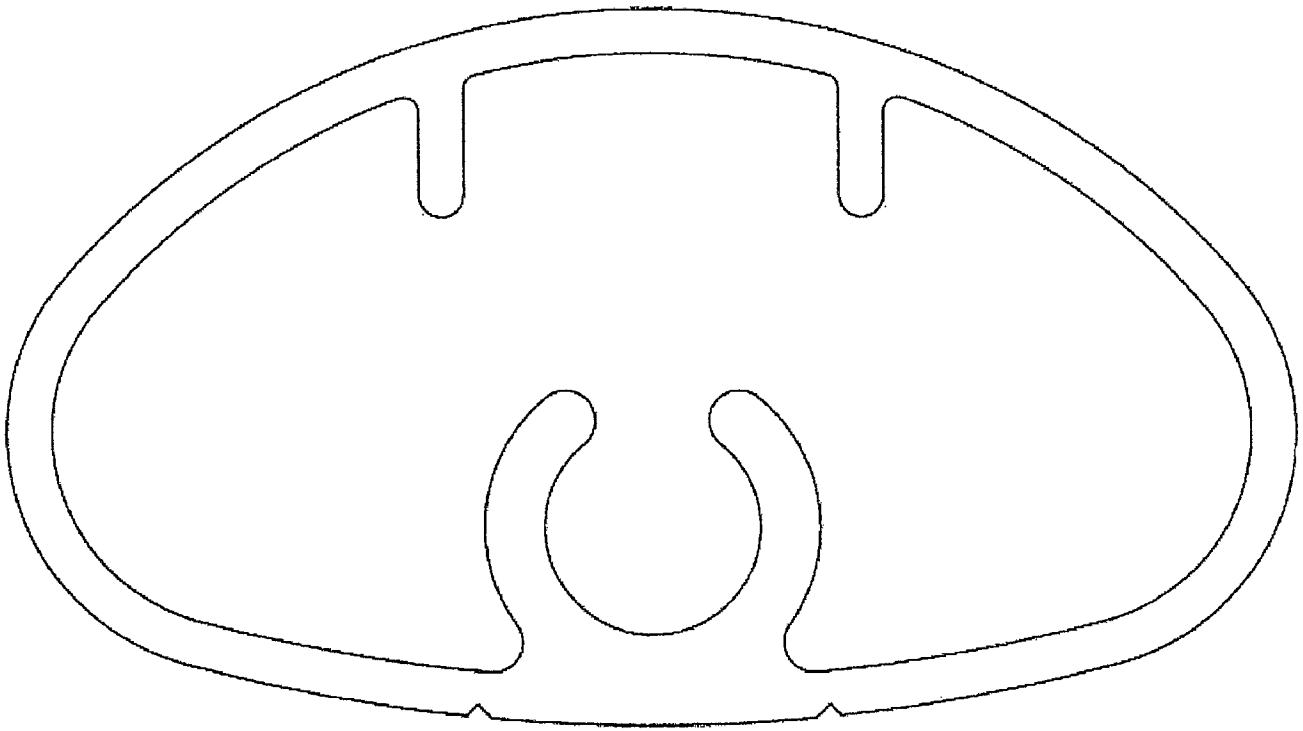
FIG. 4 shows a cross-sectional views of a foil-shaped second member according to a preferred embodiment of the present invention.
Figure 5:
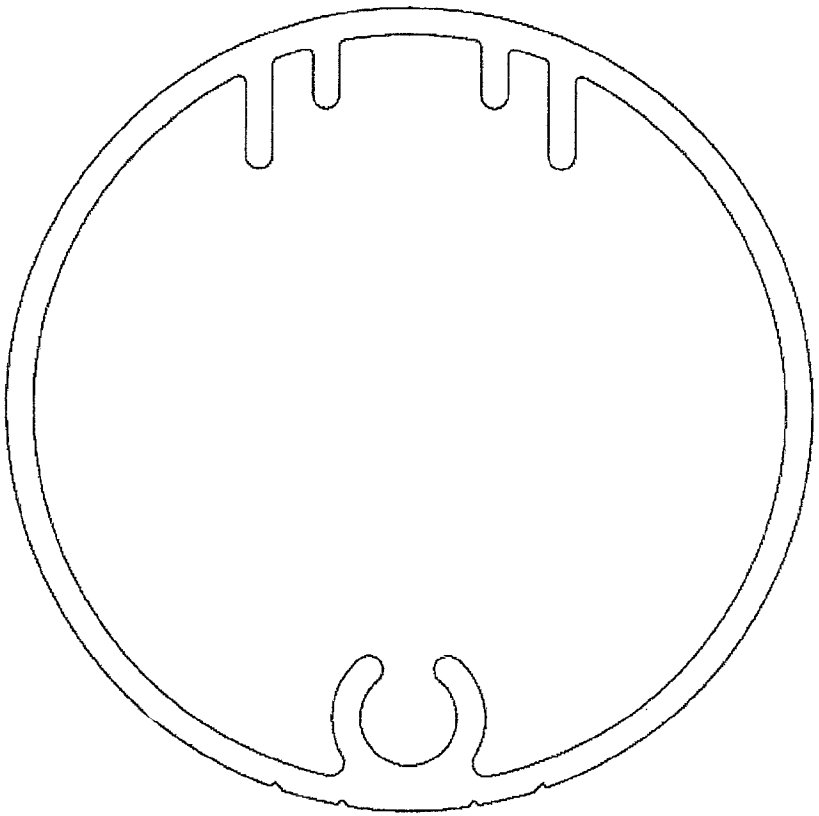
FIG. 5 shows a cross-sectional views of a circular second member according to a preferred embodiment of the present invention.
Figure 6A:
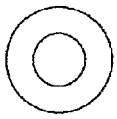
FIGS. 6*a* to 6*d* shows cross-sectional views of various cross-sectional shapes of locking members which may be used according to a preferred embodiment of the present invention.
Figure 6B:
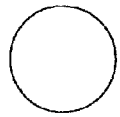
Figure 6C:
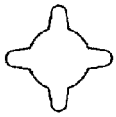
Figure 6D:
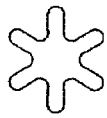
Figure 7A:
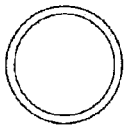
FIGS. 7*a* to 7*i* shows cross-sectional views of various cross-sectional shapes of a first member which may be used according to a preferred embodiment of the present invention.
Figure 7B:
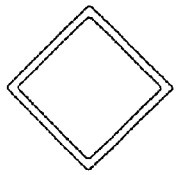
Figure 7C:
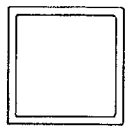
Figure 7D:
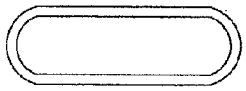
Figure 7E:
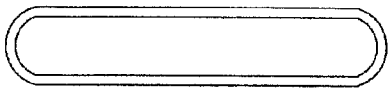
Figure 7F:
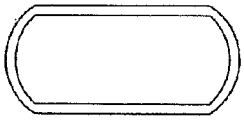
Figure 7G:
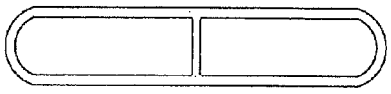
Figure 7H:
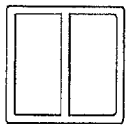
Figure 7I:
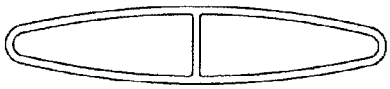
Figure 8A:
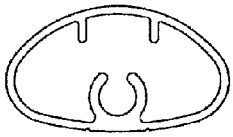
FIGS. 8*a* to 8*h* show cross-sectional views of various cross-sectional shapes of second member which may be used according to a preferred embodiment of the present invention.
Figure 8B:
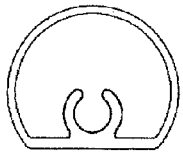
Figure 8C:
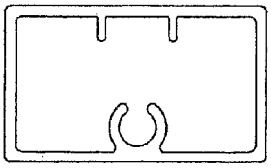
Figure 8D:
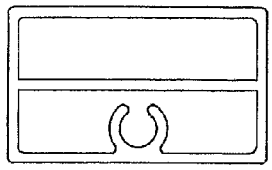
Figure 8E:
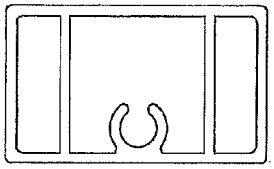
Figure 8F:
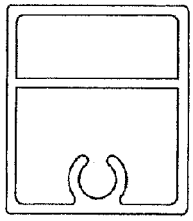
Figure 8G:
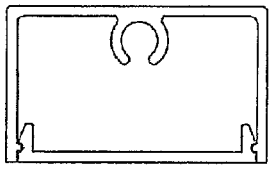
Figure 8H:
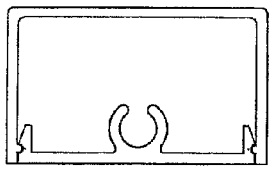
Figure 9:
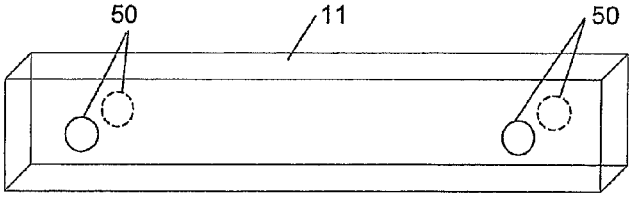
FIG. 9 is a schematic illustration of a first member according to a preferred embodiment showing the openings therein for receiving an elongate locking member.

As illustrated in FIG. 2, the invention can be put in effect in a fence panel. There is a plurality of first members 11 disposed in a substantially vertical direction. The plurality of first members 11 are disposed in a substantially vertical direction and there are two second members 12 disposed in a second direction, perpendicular to the first direction to form a network. The network has the appearance of a fence.

Each first member 11 is a paling member. The first members 11 are manufactured from aluminium. This provides the panel with the strength required to be used in security situations but remain light and slimmer in appearance than heavier or denser materials.

The arrangement of the panel illustrated is an orderly array of first members 11 with the intersection of each first member 11 with a second member 12 providing a fixture point 17. The fixture points 17 are arranged in a two-dimensional pattern as a rectangular fence.

The spacing of the first members 11 shown are such that the openings 18 between them are large enough to allow an unobstructed view or passage of air but small enough to provide security.

Each first member 11 is substantially round in cross-sectional shape. Each first member 11 is tubular in construction. The tubular construction will preferably provide strength and rigidity to the panel but not add excessive weight to the construction.

Each first member 12 is extruded. The length of the extrudate is related to the height of the panel to be formed.

Each first member 12 is between approximately 1 to 2 cm in diameter.

Each first member 11 has two passages disposed through it. Each passage has a periphery that extends around each elongate locking member 14. The passages of adjacent first members 11 are coaxial to allow the panel to be formed. The passages provide an interference fit with the exterior surface of the second members 13.

The wall thickness of each first member 11 is between approximately 0.5 mm and 10 mm.

Each second member 12 is manufactured of similar materials and in a similar way to each first member 11.

Each second member 12 is substantially rectangular in cross-sectional shape. The passage portions 13 are disposed within the rectangular cross-section of the second member 12.

Each second member 12 is extruded in any length required. Each second member is between approximately 1 cm and 10 cm in a first direction, 1 mm to 10 cm in a second direction and of any suitable length.

Each second member 12 is preferably will be tubular in construction, with the passage portions 13 disposed within the hollow interior. The tubular construction provides strength and rigidity to the panel but not add excessive weight to the construction. Solid construction may only be used in specific situations.

Each second member 12 also has at a plurality of openings disposed through it to receive the first members 11. These openings are passages and are spaced along each second member. The wall thickness of each second member will preferably be similar to the first members and is between approximately 0.5 mm and 10 mm. Thicker walls may be provided for members in larger panels, as those members will have to support a greater weight.

Each second member 12 is disposed substantially perpendicular to the first members to form a two-dimensional panel.

In use, the first members are positioned through the second members and the openings in the first members are aligned with each other and the periphery of the passage portions. The locking member is then forced through the passage portions and the openings in the first members, locking the first members to the second members. The attachment means is inside the second members and is therefore hidden from sight. The opening on the passage portions allows the locking member to be manipulated when forcing it through the passage portions in order to adjust the alignment of the locking member.

In the present specification and claims, the word "comprising" and its derivatives including "comprises" and "comprise" include each of the stated integers but does not exclude the inclusion of one or more further integers.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

The invention claimed is:

1. A panel, comprising:

a plurality of first members, each said first member being elongated, including opposite first and second ends, and having an aperture formed through the first end;

a second member being elongated, said second member including an outer wall which extends continuously to define a unitary closed perimeter that delimits a hollow interior space; and an elongated locking member;

wherein the second member further includes openings formed through the outer wall at a first side of the outer wall, the openings being configured to receive the first ends of the corresponding first members;

wherein the second member further includes a plurality of peripheral passage structures, each peripheral passage structure being disposed in the hollow interior space at the first side of the outer wall and extending between adjacent openings, the peripheral passage structures being aligned along a length of the elongated second member so as to delimit an elongated channel interrupted by the openings;

wherein the first ends of said first members are configured to be inserted into the openings and wherein the apertures are configured to align with the channel to form a continuous passageway through the first and second members; and wherein the locking member is configured to be inserted into the passageway, extending through the plurality of first members, and engaging the passageway in an interference fit to lock the first and second members together.

2. The panel according to claim 1, wherein at least one of the first members includes an aperture formed through the second end.

3. The panel according to claim 2, further comprising:

another second member; and a second elongated locking member;

wherein the second end of said at least one first member is configured to be inserted into a respective opening of said other second member;

wherein the aperture at the second end of the at least one first member is configured to align at the interior of the other second member with the channel thereof to form a continuous passageway through the first member and through said other second member; and wherein the second locking member is configured to be inserted into the passageway, extending through the at least one first member, and engaging the passageway in an interference fit to lock the second end of the first member to the other second member together.

4. The panel according to claim 3, wherein said other second member comprises an opening formed through the outer wall at a second side of the outer wall, opposite from the first side, the opening in the second side being aligned with a respective opening in the first side wherein the at least one first member extends beyond said aperture, through the respective opening in the second side and beyond the closed perimeter of the other second member.

5. The panel according to claim 3, wherein a plurality of the first members include said aperture at the respective second ends.

6. The panel according to claim 5, wherein said other second member comprises a plurality of openings formed through the outer wall at a second side of the outer wall, opposite from the first side, the openings in the second side being aligned with respective openings in the first side wherein the plurality of first members each extend beyond said aperture, through the respective opening in the second side and beyond the closed perimeter of the other second member.

7. The panel according to claim 1, wherein each of the plurality of peripheral passage structures comprises a hollow circular cross-sectional profile with at least one interruption.

8. The panel according to claim 7, wherein the interruption comprises a gap extending substantially a length of the respective peripheral passage structure.

9. The panel according to claim 8, wherein the peripheral passage structure is disposed proximate to the first side of the outer wall of the second member and wherein the gap is delimited by the peripheral passage structure at a position opposite from the first side.

10. The panel according to claim 1, wherein a cross-sectional shape of the first member comprises round, foil, oval, or rectangular.

11. The panel according to claim 1, wherein each of the members is manufactured from a metal or a plastic material.

12. The panel according to claim 1, wherein the panel is an orderly array of first and second members with the intersection of each of the first members with the second member providing a fixture point where the elongated locking member attaches the first members relative to the second member.

13. The panel according to claim 1, wherein apertures of the first members are disposed coaxial with the peripheral passage structures when the first members are received in the openings of the second member.

14. The panel according to claim 1, wherein the second member is substantially rectangular in cross-sectional shape.

15. The panel according to claim 1, wherein the panel is part of a fence, awning or roof structure.

16. The panel according to claim 1, wherein the elongated locking member has an elongated cylindrical shape with a circular cross-section.

17. The panel according to claim 1, wherein an interior of the locking member is hollow.

18. The panel according to claim 1, wherein the elongated locking member includes at least one flange which extends radially therefrom and extends a length of the locking member.

19. The panel according to claim 18, wherein each of the plurality of peripheral passage structures comprises a hollow circular cross-sectional profile with at least one interruption, wherein the interruption comprises a gap extending substantially a length of the respective peripheral passage structure, and wherein the flange is received within the gap when the elongated locking member is inserted in the peripheral passage structures such that the elongated locking member is keyed with respect to the peripheral passage structures.

20. The panel according to claim 18, wherein the elongated locking member includes four of said flanges equally spaced around a circumference of the locking member.

21. The panel according to claim 18, wherein the elongated locking member includes six of said flanges equally spaced around a circumference of the locking member.

* * * * *